US008636082B2

(12) United States Patent
Kishida

(10) Patent No.: US 8,636,082 B2
(45) Date of Patent: Jan. 28, 2014

(54) PILE DRIVER

(75) Inventor: Mitsuhiro Kishida, Nagoya (JP)

(73) Assignee: Nippon Sharyo, Ltd., Aichi (JP)

( * ) Notice: Subject to any disclaimer, the term of this patent is extended or adjusted under 35 U.S.C. 154(b) by 628 days.

(21) Appl. No.: 12/654,570

(22) Filed: Dec. 23, 2009

(65) Prior Publication Data

US 2010/0158616 A1 Jun. 24, 2010

(30) Foreign Application Priority Data

Dec. 24, 2008 (JP) ..... 2008-328185

(51) Int. Cl.
*E21B 7/02* (2006.01)

(52) U.S. Cl.
USPC ..... 173/184

(58) Field of Classification Search
USPC ..... 173/184–189, 24–28; 227/119, 147; 405/232
See application file for complete search history.

(56) References Cited

U.S. PATENT DOCUMENTS

| | | | | | |
|---|---|---|---|---|---|
| 2,715,015 | A | * | 8/1955 | Thornburg | 173/10 |
| 2,863,637 | A | * | 12/1958 | Thornburg | 91/277 |
| 3,073,463 | A | * | 1/1963 | Addicks | 414/395 |
| 3,268,211 | A | * | 8/1966 | Schlechter et al. | 254/315 |
| 3,352,540 | A | * | 11/1967 | Schlechter | 254/309 |
| 3,481,584 | A | * | 12/1969 | Robertson et al. | 254/268 |
| 3,847,231 | A | * | 11/1974 | Warjone et al. | 173/206 |
| 3,965,841 | A | * | 6/1976 | Croese | 114/230.21 |
| 3,967,736 | A | * | 7/1976 | Tarassoli | 212/286 |
| 4,140,229 | A | * | 2/1979 | Booth et al. | 414/308 |
| 4,324,387 | A | * | 4/1982 | Steinhagen | 254/310 |
| 4,436,455 | A | * | 3/1984 | Vance | 405/303 |
| 4,549,682 | A | * | 10/1985 | Hebert | 227/119 |
| 4,595,065 | A | * | 6/1986 | Wada et al. | 175/85 |
| 4,877,091 | A | * | 10/1989 | Howell, Jr. | 173/89 |
| 4,950,125 | A | * | 8/1990 | Gravenhorst | 414/569 |
| 5,040,927 | A | * | 8/1991 | Wickberg | 405/232 |
| 5,176,364 | A | * | 1/1993 | Bell | 254/291 |
| 5,256,003 | A | * | 10/1993 | Ito et al. | 405/232 |
| 5,630,477 | A | * | 5/1997 | Minatre | 173/184 |
| 5,692,733 | A | * | 12/1997 | Hiramatsu | 254/274 |
| 5,762,148 | A | * | 6/1998 | Kattentidt et al. | 173/184 |
| 5,890,844 | A | * | 4/1999 | Schellhorn | 405/267 |
| 6,315,059 | B1 | * | 11/2001 | Geldean | 173/31 |
| RE37,976 | E | * | 2/2003 | Hiramatsu | 254/274 |
| 7,063,306 | B2 | * | 6/2006 | Sanders et al. | 254/361 |
| 7,185,708 | B2 | * | 3/2007 | Wood et al. | 166/379 |
| 7,575,398 | B2 | * | 8/2009 | Lloyd et al. | 405/232 |
| 8,207,692 | B2 | * | 6/2012 | Holmberg et al. | 318/6 |
| 2005/0199316 | A1 | * | 9/2005 | Ong | 144/335 |

FOREIGN PATENT DOCUMENTS

| | | |
|---|---|---|
| JP | 2-9126 A | 8/1984 |
| JP | 6-65387 | 9/1994 |

* cited by examiner

*Primary Examiner* — Robert Long
(74) *Attorney, Agent, or Firm* — Edwards Wildman Palmer LLP; James E. Armstrong, IV; George N. Chaclas

(57) ABSTRACT

The present invention provides a pile driver capable of improving operability while preventing breakage and the like of a wire rope by relating a press-in winch and an elevation winch to each other.

Solenoid valves are arranged respectively to hydraulic circuits of both of a press-in winch and an elevation winch and an electric circuit is provided to operate the solenoid valves in a related manner so that one winch is to be capable of rotating at semi-engaging when the other winch is set to be in a winding state with automatic brake operated.

2 Claims, 5 Drawing Sheets

PILE DRIVER

BACKGROUND OF THE INVENTION

1. Field of the Invention

The present invention relates to a pile driver, in particular, relates to a wire rope press-in pile driver to operate an operation unit such as an auger drive which rises and falls along a leader with a press-in winch via a press-in rope.

2. Description of the Related Art

A wire rope press-in pile driver performs piling operation by repeating to press-in a pile by compulsorily lowering an operation unit which rises and falls along a leader via a press-in rope wound at a press-in winch and to elevate the operation unit via an elevation rope wound at an elevation winch (i.e., a winding winch) after the piling is completed. In order to repeat the lowering operation and the elevating operation of the operation unit, the press-in winch is to be in a winding state of the press-in rope and the elevation winch is to be in an unwinding state of the elevation rope when the operation unit is lowered. Then, when the operation unit is elevated, the elevation winch is to be in a winding state of the elevation rope and the press-in winch is to be in an unwinding state of the press-in rope.

As such a wire rope press-in pile driver, it is known to configure to draw a wire rope from a drum while applying appropriate tension to the wire rope by adopting a hydraulic circuit configuration in which a press-in winch is automatically to be in a free-fall mode in accordance with winding operation of an elevation winch when winding an elevation rope (for example, see Japanese Patent Application Publication (JP-B) No. 2-9126) and a hydraulic circuit configuration in which a clutch arranged between a drum shaft and a drum of a winch is to be in a semi-engaging state (for example, see Japanese Utility-model Application Laid-Open (JP-U) No. 6-65387).

SUMMARY OF THE INVENTION

In the configuration of the related art, when a switch is forgotten to be turned on or to be turned off, there may be a case that excessive tension force is applied to a wire rope or that the wire rope is loosened.

The present invention provides a pile driver capable of improving the operability while preventing breakage and loosening of a wire rope by relating a press-in winch and an elevation winch to each other.

To address this issue, the present invention provides a pile driver including a press-in winch which lowers an operation unit along a leader, and an elevation winch which elevates the operation unit along the leader, wherein a hydraulic circuit of the press-in winch and a hydraulic circuit of the elevation winch are respectively provided with a torque changing solenoid valve which switches the torque of each drum of each winch to previously set low torque compared to high torque for winding and a brake release solenoid valve which releases a brake arranged to each drum, and an electric circuit having a switching switch to operate each solenoid valve is provided so that the electric circuit respectively sets the torque changing solenoid valve of the press-in winch into a low torque state, the brake release solenoid valve thereof into a brake release state, the torque changing solenoid valve of the elevation winch into a high torque state, and the brake release solenoid valve thereof into a brake state, when the switching switch is switched to an operation unit elevating position; and respectively sets the torque changing solenoid valve of the press-in winch into a high torque state, the brake release solenoid valve thereof into a brake state, the torque changing solenoid valve of the elevation winch into a low torque state, and the brake release solenoid valve thereof into a brake release state, when the switching switch is switched to an operation unit lowering position.

Further, in a pile driver of the present invention, the torque changing solenoid valve is arranged at a hydraulic circuit to switch a clutch arranged between a drum shaft and a drum of the winch between an engaging state and an semi-engaging state, and the clutch is to be in the engaging state when the torque changing solenoid valve is switched to the high torque state and to be in the semi-engaging state when the torque changing solenoid valve is switched to the low torque state. Alternately, the torque changing solenoid valve is arranged at a hydraulic circuit to switch set pressure of a relief valve arranged at an hydraulic motor of the winch between a high pressure state and a low pressure state which are previously set, and the set pressure of the relief valve is to be in the high pressure state when the torque changing solenoid valve is switched to the high torque state and to be in the low pressure state when the torque changing solenoid valve is switched to the low torque state. Further, the set pressure of the relief valve is formed to be capable of being adjustable within a predetermined pressure range.

According to a pile driver of the present invention, when one of the press-in winch and the elevation winch is set to be in a winding state of the high torque state, the other is to be in the low torque state while braking is automatically released. Therefore, the wire rope is prevented from being applied with excessive tension force caused by both of the winches in the winding state and from being loosened caused by free rotation of a drum of the unwinding side.

DETAILED DESCRIPTION OF THE EMBODIMENTS

Figure 1:
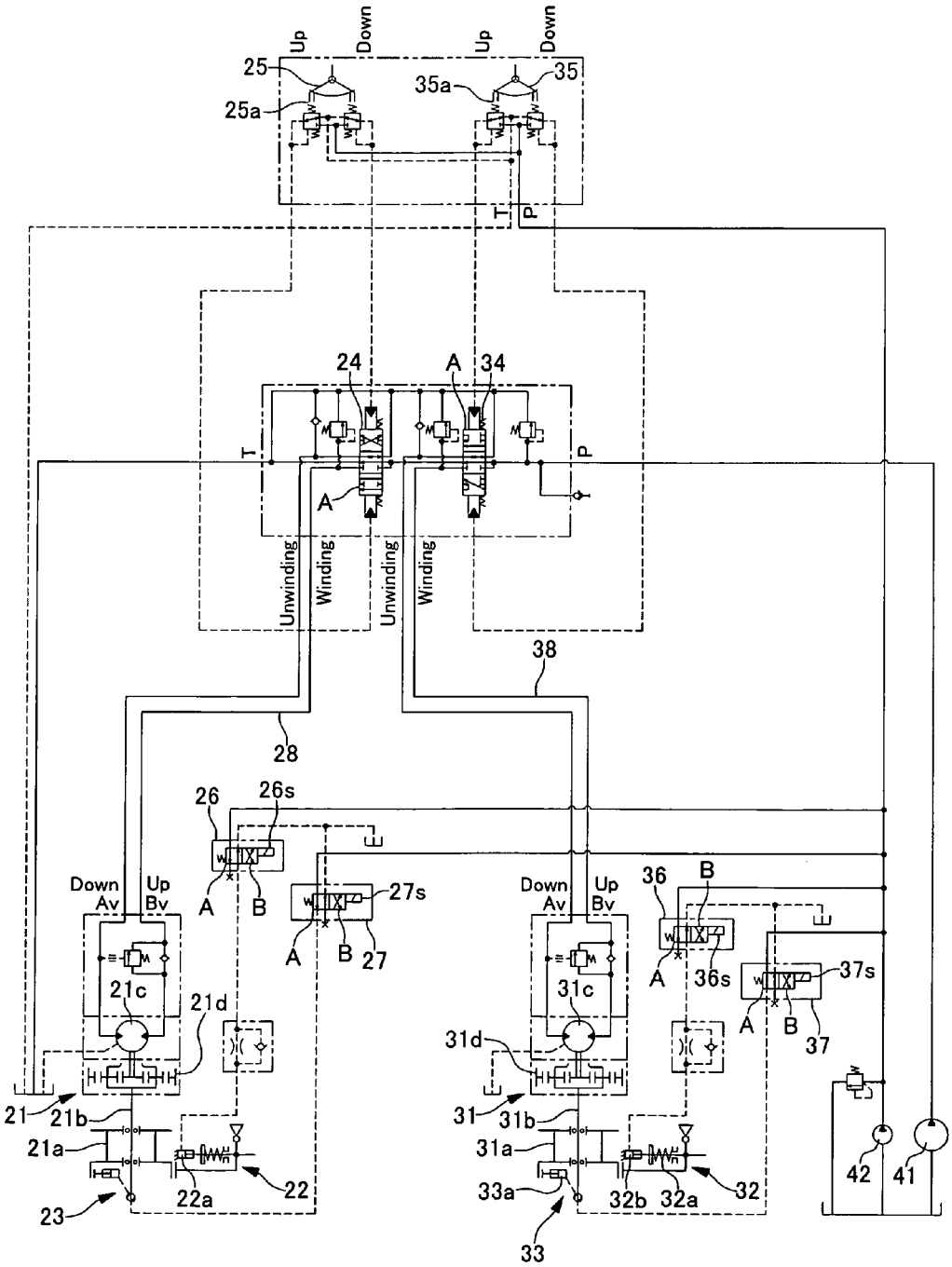
FIG. 1 is a hydraulic circuit diagram of a winch of a pile driver according to an embodiment of the present invention.
Figure 2:
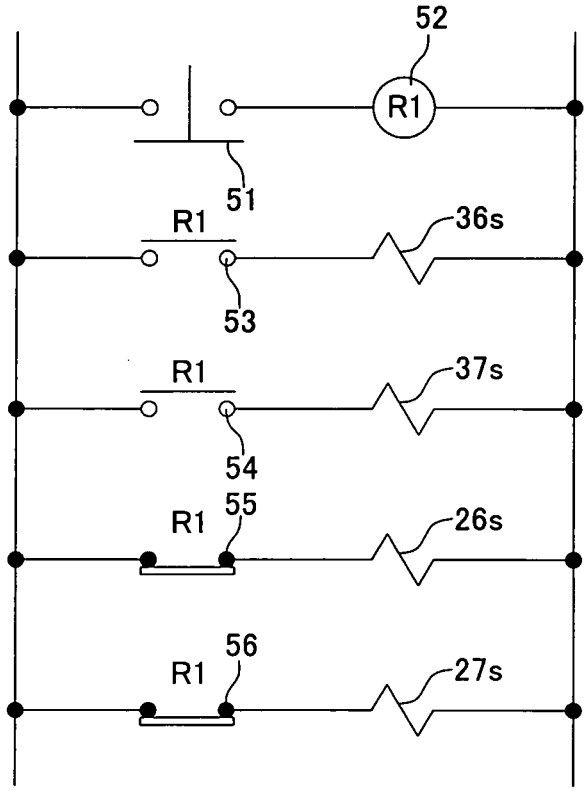
FIG. 2 is an electric circuit diagram of the same.
Figure 3:
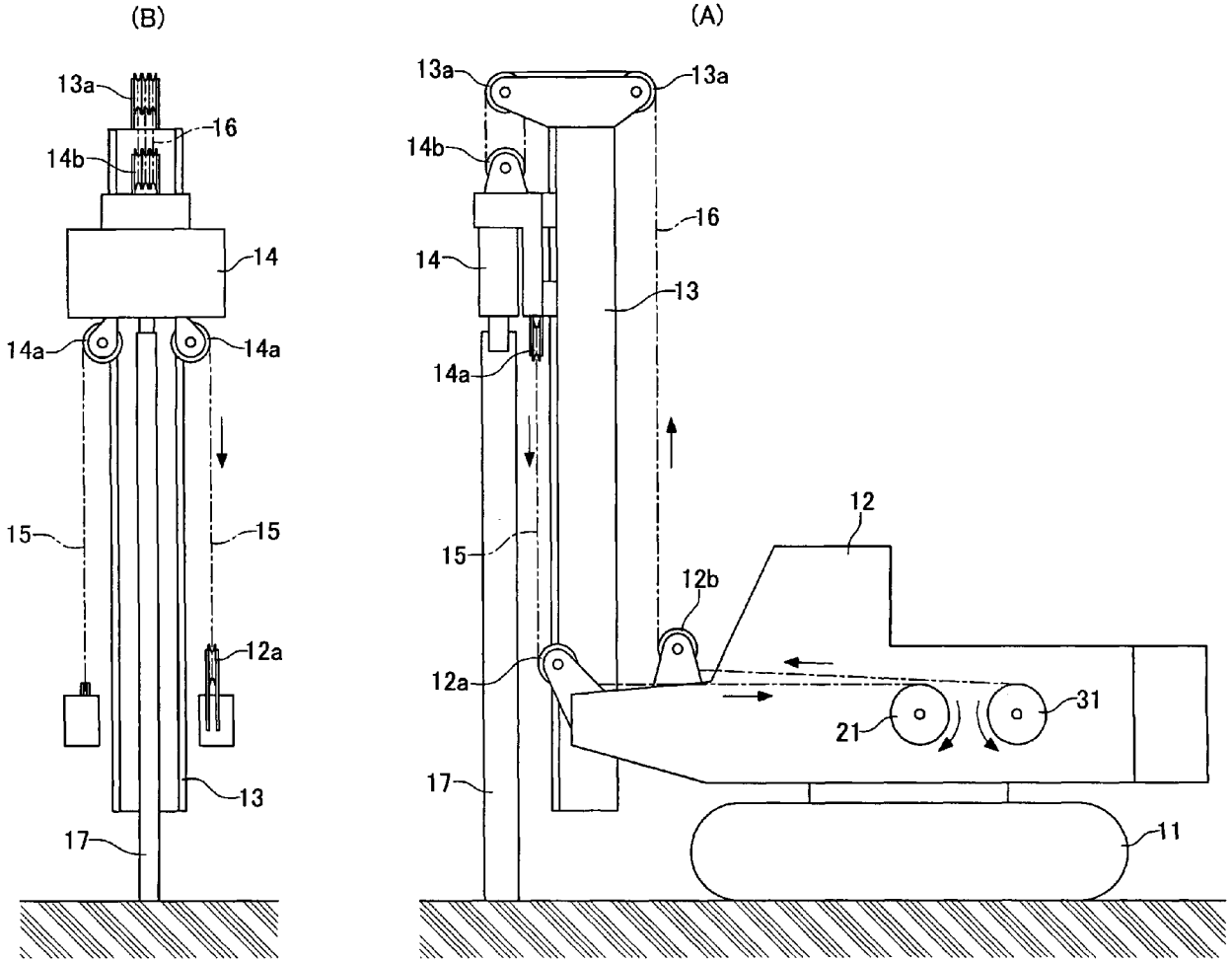
FIG. 3 is a schematic view of a wire rope press-in pile driver.

FIGS. 1 to 3 illustrate a pile driver of an embodiment of the present invention. FIG. 1 is a hydraulic circuit diagram of winches and FIG. 2 is an electric circuit diagram. FIGS. 3A and 3B are schematic views of a wire rope press-in pile driver. FIG. 3A is a side view and FIG. 3B is a main part front view.

As illustrated in FIGS. 3A and 3B, the wire rope press-in pile driver includes a lower travel unit 11 having a crawler, an upper revolving unit 12 arranged on the lower travel unit 11 as being capable of revolving, a leader 13 erectly arranged at the front part of the upper revolving unit 12, an operation unit 14 such as an auger drive arranged as being capable of rising and falling along the leader 13, a press-in winch 21 to lower the operation unit 14 via a press-in rope 15, and an elevation winch 31 to elevate the operation unit 14 via an elevation rope 16.

The press-in rope 15 is drawn from a drum 21*a* (see FIG. 1) of the press-in winch 21 and is wound and hung on a plurality of sheaves 14*a* arranged at the lower part of the operation unit 14 via a plurality of sheaves 12*a* arranged at the front part of the upper revolving unit 12. Thereafter, the top end of the press-in rope 15 is fixed to the upper revolving unit 12. Accordingly, by operating the press-in winch 21 in the winding direction, the operation unit 14 can be lowered via the press-in rope 15.

The elevation rope 16 is drawn from a drum 31*a* (see FIG. 1) of the elevation winch 31 and is wound and hung on a plurality of sheaves 14*b* arranged at the upper part of the operation unit 14 via a sheave 12*b* arranged at the front part of the upper revolving unit 12 and a plurality of sheaves 13*a* arranged at the top end of the leader 13. Thereafter, the top end of the elevation rope 16 is fixed to the upper revolving unit 12. Accordingly, by operating the elevation winch 31 in the winding direction, the operation unit 14 can be elevated via the elevation rope 16.

When piling a pile 17 with the pile driver, the operation unit 14 is operated after the pile 17 is mounted thereto and the press-in rope 15 is wound by operating the press-in winch 21. Thus, the pile 17 is piled into the ground by lowering the operation unit 14. In accordance with the lowering of the operation unit 14, the elevation rope 16 is drawn from the drum 31*a* of the elevation winch 31.

After completing the laying of the pile 17, the operation unit 14 is separated from the embedded pile 17 and the elevation rope 16 is wound by operating the elevation winch 31 for laying another pile. Thus, the operation unit 14 is elevated toward the upper part of the leader 13. In accordance with the elevating of the operation unit 14, the press-in rope 15 is drawn from the drum 21*a* of the press-in winch 21.

In this manner, a predetermined number of piles 17 are sequentially piled into predetermined positions by repeating the lowering operation of the operation unit 14 in the state of winding the press-in rope 15 by the press-in winch 21 while drawing the elevation rope 16 from the elevation winch 31 and the elevating operation of the operation unit 14 in the state of winding the elevation rope 16 by the elevation winch 31 while drawing the press-in rope 15 from the press-in winch 21.

The hydraulic circuit of FIG. 1 and the electric circuit of FIG. 2 illustrate the configuration in which one winch is automatically to be capable of unwinding the wire rope with a measure of resistance when the other winch is set to a winding state by relating the press-in winch 21 and the elevation winch 31 to each other.

The press-in winch 21 and the elevation winch 31 of FIG. 1 respectively include a brake mechanism 22, 32 and a clutch mechanism 23, 33 which are operable with oil pressure. The clutch mechanism 23, 33 adopts a known clutch mechanism capable of switching between an engaging state and a semi-engaging state (i.e., a half-clutch state) of a drum shaft and the drum.

The hydraulic circuit includes a circuit of drive pressure oil pressurized by a first hydraulic pump 41 and a circuit of control pressure oil pressurized by a second hydraulic pump 42. A press-in control valve 24 and an elevation control valve 34 arranged in series at the circuit of drive pressure oil are controlled with the control pressure oil by operating a press-in operation lever 25 and an elevation operation lever 35 which are arranged in parallel at the circuit of control pressure oil. Accordingly, the drive pressure oil is supplied to the press-in winch 21 and the elevation winch 31 so as to operate respectively in normal rotation of the wire rope winding direction and in reverse rotation of the wire rope unwinding direction.

Further, the circuit of control pressure oil is provided with a solenoid valve for press-in brake release (hereinafter, called the press-in brake valve) 26 which switches the brake mechanism 22 for the press-in winch 21 between an operation state and a release state, a solenoid valve for press-in clutch switching (hereinafter, called the press-in clutch valve) 27 as a torque changing solenoid valve which switches the clutch mechanism 23 between an engaging state and a semi-engaging state, a solenoid valve for elevation brake release (hereinafter, called the elevation brake valve) 36 which switches the brake mechanism 32 for the elevation winch 31 between an operation state and a release state, and a solenoid valve for elevation clutch switching (hereinafter, called the elevation clutch valve) 37 as a torque changing solenoid valve which switches the clutch mechanism 33 between an engaging state and a semi-engaging state.

Positions of the respective valves 26, 27, 36, 37 are switched in relation to one another by the electric circuit of FIG. 2. The electric circuit includes a drive operation switching switch 51 to switch between the press-in operation and the elevation operation, a relay 52 operated by closing the drive operation switching switch 51, and four relay contacts 53, 54, 55, 56 which are opened and closed by the operation of the relay 52. The first relay contact 53 and the second relay contact 54 are configured to be both OFF when the drive operation switching switch 51 is OFF (i.e., the state of FIG. 2), and then, to be both ON when the drive operation switching switch 51 is ON. The third relay contact 55 and the fourth relay contact 56 are configured to be both ON when the drive operation switching switch 51 is OFF (i.e., the state of FIG. 2), and then, to be both OFF when the drive operation switching switch 51 is ON.

Further, a solenoid 36*s* of the elevation brake valve 36 and a solenoid 37*s* of the elevation clutch valve 37 are connected respectively to the first relay contact 53 and the second relay contact 54. A solenoid 26*s* of the press-in brake valve 26 and a solenoid 27*s* of the press-in clutch valve 27 are connected respectively to the third relay contact 55 and the fourth relay contact 56.

In the state that the drive operation switching switch 51 is OFF as illustrated in FIG. 2, since the relay 52 is not powered, both of the first relay contact 53 and the second relay contact 54 are OFF and both of the third relay contact 55 and the fourth relay contact 56 are ON as the state of performing the elevation operation of the operation unit 14. Accordingly, the solenoid 36*s* and the solenoid 37*s* are not operated, so that both of the elevation brake valve 36 and the elevation clutch valve 37 remain respectively at position A in FIG. 1. By interrupting the control pressure oil from the second hydraulic pump 42 at the elevation brake valve 36, the brake mechanism 32 of the elevation winch 31 is to be in the operation state (i.e., the automatic brake state) due to action of a spring 32*a*. Then, the control pressure oil passes through the elevation clutch valve 37 and is supplied to a cylinder 33*a* of the clutch mechanism 33, so that the clutch arranged between the drum shaft 31*b* and the drum 31*a* of the elevation winch 31 is to be in the engaging state (i.e., the high torque state).

Meanwhile, since both of the third relay contact 55 and the fourth relay contact 56 are ON, the solenoid 26*s* of the press-in brake valve 26 and the solenoid 27*s* of the press-in clutch valve 27 are respectively operated. The press-in brake valve 26 and the press-in clutch valve 27 are moved toward the left side in FIG. 1 to be respectively at position B. The control pressure oil passing through the press-in brake valve 26 is supplied to a cylinder 22*a* of the brake mechanism 22, so that the braking is released and a drum 21*a* is to be rotatable. In addition, since the control pressure oil is interrupted at the press-in clutch valve 27, the clutch mechanism 23 is in the semi-engaging state so as to apply previously set constant rotational resistance to the drum 21*a* (i.e., the low torque state).

When the elevation operation lever 35 is operated toward the winding direction 35*a* side from the neutral position of FIG. 1 in the state that the drive operation switching switch 51 is OFF, the control pressure oil presses the elevation control valve 34 downward in FIG. 1 so as to move to position A. Accordingly, the drive pressure oil pressurized by the first hydraulic pump 41 is supplied from the elevation control valve 34 to a winding side circuit 38 of the elevation winch 31, so that a hydraulic motor 31*c* of the elevation winch 31 is rotated in the normal direction. Simultaneously, a part of the drive pressure oil is branched from the winding side circuit 38 to an automatic brake release passage (not illustrated), so that the automatic brake state at the brake mechanism 32 is released in a known manner.

The normal rotation of the hydraulic motor 31*c* at the elevation winch 31 is transmitted to the drum shaft 31*b* via a decelerator 31*d*, and is further transmitted from the drum shaft 31*b* to the drum 31*a* via the clutch mechanism 33. Accordingly, the drum 31*a* is rotated in the winding direction to wind the elevation rope 16, so that the operation unit 14 is elevated toward the upper side of the leader 13.

When the operation unit 14 is elevated, tension force is applied to the press-in rope 15 which is wound and hung on the sheave 14*a* of the operation unit 14. Accordingly, the press-in rope 15 is drawn from the drum 21*a* having the predetermined rotational resistance due to the semi-engaging. At that time, the drum 21*a* is rotated in the state that the press-in rope 15 is appropriately tightened due to appropriate rotational resistance caused by the semi-engaging. Then, when the elevation winch 31 is stopped by returning the elevation operation lever 35 to the neutral position, the rotation of the drum 21*a* is stopped due to the action of the semi-engaging at the time of disappearing of the tension force applied to the press-in rope 15. In this manner, since the drum 21*a* continues to rotate even after the elevation winch 31 is stopped, the press-in rope 15 can be prevented from being loosened.

Further, even in a case that the press-in operation lever 25 is operated toward the winding direction 25*a* side from the neutral position of FIG. 1 by mistake in the state that the drive operation switching switch 51 is OFF, the drum shaft 21*b* freewheels against the drum 21*a* since the clutch mechanism 23 is in the semi-engaging state. Therefore, large tension force is not applied to the press-in rope 15 and the elevation rope 16.

When the drive operation switching switch 51 is turned on in order to perform the lowering operation of the operation unit 14, namely, to perform the piling operation, the relay 52 is to be in the powered state. Accordingly, both of the first relay contact 53 and the second relay contact 54 are to be ON, and both of the third relay contact 55 and the fourth relay contact 56 are to be OFF. Therefore, the elevation brake valve 36 and the elevation clutch valve 37 are switched respectively to position B due to operation of the solenoid 36*s* and the solenoid 37*s*. The control pressure oil is supplied to a cylinder 32*b* of the brake mechanism 32 via the elevation brake valve 36, and then, the braking is released by compressing the spring 32*a* by the operation of the cylinder 32*b*. In addition, since the control pressure oil is interrupted at the elevation clutch valve 37, the pressure oil is drained from the cylinder 33*a* of the clutch mechanism 33 and the clutch mechanism 33 is to be in the semi-engaging state.

Meanwhile, since both of the third relay contact 55 and the fourth relay contact 56 are OFF, the press-in brake valve 26 and the press-in clutch valve 27 return respectively to the home position. That is, the press-in brake valve 26 and the press-in clutch valve 27 are to be respectively at position A in FIG. 1. Accordingly, since the control pressure oil is interrupted at the press-in brake valve 26, the brake mechanism 22 is to be in the automatic brake state. Further, since the control pressure oil is supplied to the cylinder 23*a* of the clutch mechanism 23 via the press-in clutch valve 27, the clutch arranged between the drum shaft 21*b* and the drum 21*a* of the press-in winch 21 is to be in the engaging state.

After turning on the drive operation switching switch 51 to switch the hydraulic circuit to the piling operation state as described above, when the press-in operation lever 25 is operated toward the winding direction 25*a* side from the neutral position of FIG. 1, the control pressure oil presses the press-in control valve 24 upward in FIG. 1 to move to position A. Accordingly, the drive pressure oil pressurized by the first oil pump 41 passing through the elevation control valve 34 is supplied to the winding side circuit 28 of the press-in winch 21 via the press-in control valve 24, so that a hydraulic motor 21*c* of the press-in winch 21 is rotated in the normal direction. Simultaneously, a part of the drive pressure oil is branched from the winding side circuit 28 to an automatic brake release passage (not illustrated), so that the automatic brake state at the brake mechanism 22 is released in a known manner.

The normal rotation of the hydraulic motor 21*c* at the press-in winch 21 is transmitted to the drum shaft 21*b* via a decelerator 21*d*, and is further transmitted from the drum shaft 21*b* to the drum 21*a* via the clutch mechanism 23. Accordingly, the drum 21*a* is rotated in the winding direction to wind the press-in rope 15, so that the operation unit 14 is moved toward the lower side of the leader 13. Then, the pile 17 mounted to the operation unit 14 is piled into the ground. In accordance with the lowering of the operation unit 14, the elevation rope 16 is drawn from the drum 31*a* which is maintained at the semi-engaging state. When the operation unit 14 is stopped, the rotation of the drum 31*a* is stopped as well by the action of the semi-engaging. Further, as described above, even in a case that the elevation operation lever 35 is operated by mistake in this state, since the clutch mechanism 33 is in the semi-engaging state, the drum 31*a* freewheels and large tension force is not applied to the press-in rope 15 and the elevation rope 16.

In this manner, by switching the drive operation switching switch 51 to the ON position to perform the piling operation, the press-in winch 21 is to be in the automatic brake state and the elevation winch 31 is to be capable of being rotated while receiving appropriate rotational resistance due to the semi-engaging. Accordingly, the piling operation of the pile 17 can be performed while respectively preventing the press-in rope 15 and the elevation rope 16 from being applied with large tension force and from being loosened.

On the other hand, as described above, by switching the drive operation switching switch 51 to the OFF position to elevate the operation unit 14, the elevation winch 31 is to be in the automatic brake state and the press-in winch 21 is to be capable of being rotated while receiving appropriate rotational resistance due to the semi-engaging. Accordingly, the operation unit 14 can be elevated along the leader 13 while respectively preventing the press-in rope 15 and the elevation rope 16 from being applied with large tension force and from being loosened.

In addition, since the lowering operation of the operation unit 14 is performed only by the press-in operation lever 25 and the elevating operation of the operation unit 14 is performed only by the elevation operation lever 35, the operability is improved as well. Further, even in a case that the operation lever 25, 35 is operated by mistake, freewheeling occurs in the semi-engaging state. Therefore, each portion can be prevented from being damaged even when switching of the drive operation switching switch 51 is forgotten.

Figure 4:
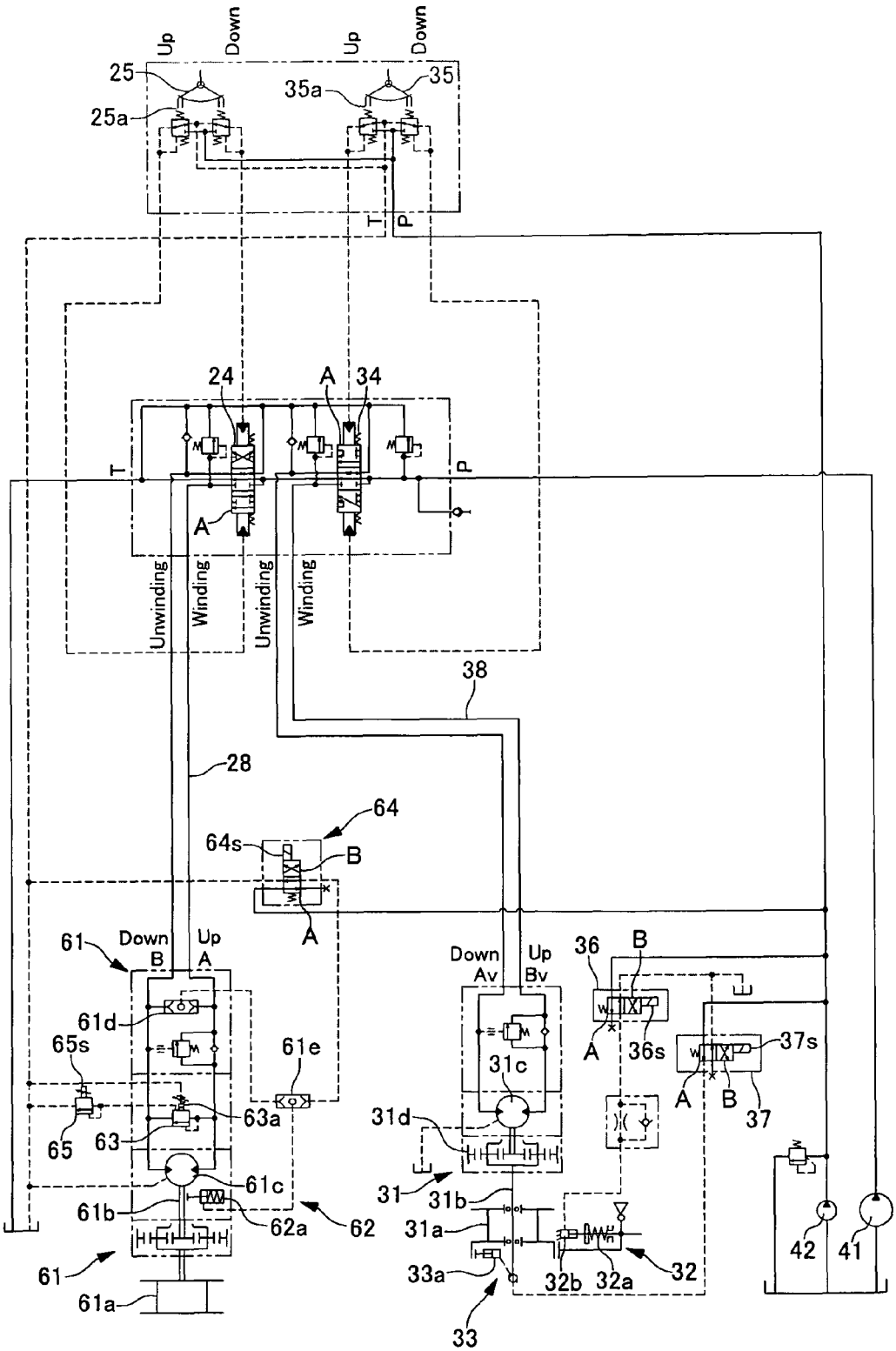
FIG. 4 is a hydraulic circuit diagram of a winch of a pile driver according to another embodiment of the present invention.
Figure 5:
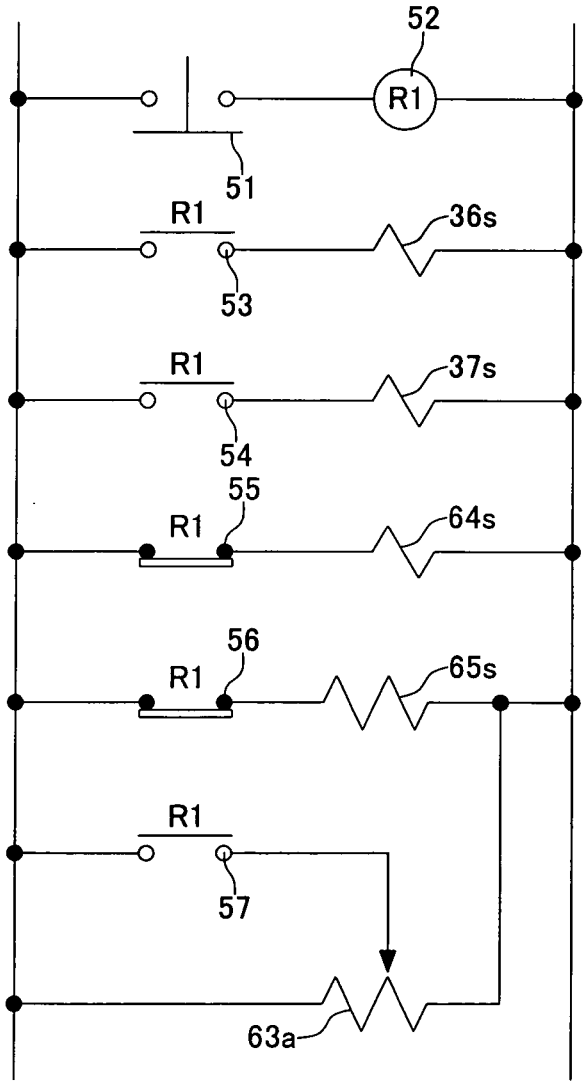
FIG. 5 is an electric circuit diagram of the same.

FIGS. 4 and 5 illustrate a pile driver of another embodiment of the present invention. FIG. 4 is a hydraulic circuit diagram of winches and FIG. 5 is an electric circuit diagram. In the following description, the same numeral is given to the same structural element of the abovementioned embodiment and the description will not be repeated.

In an example of the present embodiment, one winch is utilized for a press-in winch 61 adopting a negative brake mechanism 62 for replacing the abovementioned brake mechanism, and a mechanism to switch set pressure of a relief valve 63 between high pressure and low pressure for replacing the abovementioned clutch mechanism. Further, in the electric circuit, corresponding to the configuration of the press-in winch 61, a solenoid 64*s* of a solenoid valve 64 for negative brake release to release the negative brake mechanism 62 and a solenoid 65*s* of a solenoid valve 65 for relief pressure setting as a solenoid valve for torque changing to switch the set pressure of the relief valve 63 are connected respectively to the third relay contact 55 and the fourth relay contact 56 which are to be both ON when the drive operation switching switch 51 is OFF and to be both OFF when the drive operation switching switch 51 is ON.

Further, the present embodiment is provided with a circuit of a relief pressure setting portion 63*a* to adjust the relief pressure of the relief valve 63 as a fifth relay contact 57. The fifth relay contact 57 is to be ON when the drive operation switching switch 51 is ON, so that the relief pressure of the relief valve 63 is to be the pressure which is set at the relief pressure setting portion 63*a*. The fifth relay contact 57 is to be OFF when the drive operation switching switch 51 is OFF, so that the relief pressure of the relief valve 63 is to be the initial set pressure.

When the drive operation switching switch 51 is OFF as illustrated in FIG. 5, it is the state of performing the elevation operation of the operation unit 14 as similar to the above description. Since both of the first relay contact 53 and the second relay contact 54 are OFF, the elevation brake valve 36 and the elevation clutch valve 37 are located respectively at position A as shown in FIG. 4. Accordingly, similar to the above description, the brake mechanism 32 of the elevation winch 31 is to be in the automatic brake state and the clutch mechanism 33 is in the engaging state (i.e., the high torque state).

Meanwhile, since the third relay contact 55 is ON and the solenoid 64*s* of the solenoid valve 64 for negative brake release is in a powered state, the solenoid valve 64 for negative brake release is switched to position B and the control pressure oil is supplied to a cylinder 62*a* of the negative brake mechanism 62 via the solenoid valve 64 for negative brake release. Accordingly, the negative brake is released and the drum 61*a* is to be rotatable. Further, since the fourth relay contact 56 is ON and the solenoid 65*s* of the solenoid valve 65 for relief pressure setting is in a powered state, the solenoid valve 65 for relief pressure setting is switched from the high pressure side to the low pressure side. Accordingly, the set pressure of the relief valve 63 is switched from the initial high pressure state to a low pressure state which is previously set (i.e., the low torque state), for example, being a connected state (i.e., the set pressure is zero).

When the elevation operation lever 35 is operated to the winding direction 35*a* side in the state that the drive operation switching switch 51 is OFF, the drive pressure oil from the first hydraulic pump 41 is supplied to the winding side circuit 38 of the elevation winch 31 via the elevation control valve 34, as similar to the above. Accordingly, the hydraulic motor 31*c* is rotated in the normal direction and the automatic brake state is released. Then, the drum 31*a* winds the elevation rope 16, so that the operation unit 14 is elevated.

When the tension force of the elevation rope 15 in accordance with the elevation of the operation unit 14 is applied to the drum 61*a* as rotating force, the torque is exerted to a hydraulic motor 61*c* from the drum 61*a* via the drum shaft 61*b*. The hydraulic motor 61*c* is rotated when the torque exceeds the low pressure state set at the relief valve 63. Accordingly, the drum 61*a* is rotated in the state that the rotational resistance corresponding to the low pressure state set at the relief valve 63 is applied. Thus, when the operation unit 14 is stopped, the drum 61*a* of the press-in winch 61 is stopped as well. In this manner, the press-in rope 15 and the elevation rope 16 can be prevented from being applied with large tension force and from being loosened.

On the other hand, when drive operation switching switch 51 is turned on and the relay 52 is to be in a powered state, both of the first relay contact 53 and the second relay contact 54 are to be ON. Accordingly, the braking is released at the brake mechanism 32 and the clutch mechanism 33 is to be in the semi-engaging state, as similar to the above. Meanwhile, since the third relay contact 55 is to be OFF, the solenoid valve 64 for negative brake release is returned to position A. Accordingly, the control pressure oil is interrupted and the negative brake mechanism 62 is to be in the operation state. Further, since the fourth relay contact 56 is to be OFF, the solenoid valve 65 for relief pressure setting is returned to the normal high pressure side. In addition, the fifth relay contact 57 is to be ON and the operation of the relief pressure setting portion 63*a* is started. Then, the relief pressure of the relief valve 63 is set at the set pressure which is adjusted by the relief pressure setting portion 63*a* within a predetermined range.

When the press-in operation lever 25 is operated to the winding direction 25*a* side in the state that the drive operation switching switch 51 is ON, the control pressure oil is supplied to the winding side circuit 28 of the press-in winch 21 via the press-in control valve 24 and the hydraulic motor 61*c* is rotated in the normal direction. Simultaneously, a part of the control pressure oil branched from the winding side circuit 28 is supplied to a cylinder 62*a* via a first check valve 61*d* and a second check valve 61*e*, so that the negative braking at the negative brake mechanism 62 is released. Due to the normal rotation of the hydraulic motor 61*c*, the drum 61*a* is rotated in the winding direction to wind the press-in rope 15. Then, the operation unit 14 is lowered and the pile 17 is piled into the ground with the force corresponding to the relief pressure which is set at the relief pressure setting portion 63*a*. In accordance with the lowering of the operation unit 14, as similar to the above, the elevation rope 16 is drawn from the drum 31*a* which is maintained at the semi-engaging state. Then, when the operation unit 14 is stopped, the rotation of the drum 31*a* is stopped as well due to the action of the semi-engaging.

As described above, even in the case of utilizing a winch with the negative brake mechanism 62 without a clutch mechanism and a brake mechanism, the similar function to the semi-engaging in the abovementioned embodiment can be obtained by switching the set pressure of the relief valve 63 arranged at the hydraulic motor 61*c*. Accordingly, similar to the above, the operation unit can be elevated and lowered simply by switching the drive operation switching switch 51 in accordance with operation and by operating each operation lever. Here, it is also possible that both of winches are constituted without a clutch and a brake.

As described in the both embodiments, both winches are related so that one winch is automatically set to be capable of being rotated when the other winch is set to be in the winding state with the automatic brake operated. Therefore, in either case of performing elevating or lowering of the operation unit, fears of breakage of the press-in rope and the elevation rope due to applying large tension force by mistake and loosening of the wire rope can be reliably eliminated. Accordingly, a burden of an operator can be remarkably reduced.

What is claimed is:

1. A pile driver comprising:

a leader having a bottom and a top;

a press-in winch which lowers an operation unit towards the bottom of the leader, the press-in winch having a brake with a drum; and an elevation winch which elevates the operation unit towards the top of the leader, the elevation winch having a brake with a drum;

wherein a hydraulic circuit of the press-in winch and a hydraulic circuit of the elevation winch are respectively provided with a torque changing solenoid valve which switches the torque of each winch to previously set low torque compared to high torque for winding and a brake release solenoid valve which releases the brake of each winch, wherein high torque is a fully-engaged state and low torque is a semi-engaging state in which the respective drum will be held but move in response to an opposing winch in high torque; and an electric circuit having a switching switch to operate each solenoid valve is provided so that the electric circuit respectively sets the torque changing solenoid valve of the press-in winch into a low torque state, the brake release solenoid valve thereof into a brake release state, the torque changing solenoid valve of the elevation winch into a high torque state, and the brake release solenoid valve thereof into a brake state, when the switching switch is switched to an operation unit elevating position; and respectively sets the torque changing solenoid valve of the press-in winch into a high torque state, the brake release solenoid valve thereof into a brake state, the torque changing solenoid valve of the elevation winch into a low torque state, and the brake release solenoid valve thereof into a brake release state, when the switching switch is switched to an operation unit lowering position.

2. The pile driver according to claim 1, wherein the torque changing solenoid valve is arranged at a hydraulic circuit to switch a clutch arranged between a drum shaft and a drum of the winch between an engaging state and an semi-engaging state; and the clutch is to be in the engaging state when the torque changing solenoid valve is switched to the high torque state and to be in the semi-engaging state when the torque changing solenoid valve is switched to the low torque state.

* * * * *